US006854217B2

(12) United States Patent
Bockheim et al.

(10) Patent No.: US 6,854,217 B2
(45) Date of Patent: Feb. 15, 2005

(54) WORKSTATION WITH PIVOTING WALL

(75) Inventors: Robert J. Bockheim, Grand Rapids, MI (US); William Frederick Schacht, East Grand Rapids, MI (US); Linda Elizabeth Chesser Schacht, East Grand Rapids, MI (US); Scott E. Carpenter, Grand Rapids, MI (US); Michael G. Fedrigo, Grand Rapids, MI (US)

(73) Assignee: Nucraft Furniture Company, Comstock Park, MI (US)

( * ) Notice: Subject to any disclaimer, the term of this patent is extended or adjusted under 35 U.S.C. 154(b) by 253 days.

(21) Appl. No.: 10/163,958

(22) Filed: Jun. 6, 2002

(65) Prior Publication Data

US 2003/0227237 A1 Dec. 11, 2003

(51) Int. Cl.[7] ..... E04H 1/00

(52) U.S. Cl. ..... 52/36.1; 52/239; 52/36.4; 52/36.5; 312/313; 312/315; 108/33; 108/35; 108/134

(58) Field of Search ..... 52/36.1, 64, 239, 52/242, 220.7, 36.4, 36.5; 160/135; 312/248, 313, 315; 108/33, 35, 134

(56) References Cited

U.S. PATENT DOCUMENTS

| | | | | | |
|---|---|---|---|---|---|
| 3,078,133 | A | | 2/1963 | Schauer | |
| 3,537,769 | A | * | 11/1970 | Di Carlo | 312/277 |
| 3,748,010 | A | * | 7/1973 | Garte | 312/314 |
| 3,960,420 | A | * | 6/1976 | Speraw et al. | 312/140.1 |
| 4,559,410 | A | | 12/1985 | Hostetter | |
| 4,979,785 | A | * | 12/1990 | Richards | 312/201 |
| 5,130,494 | A | | 7/1992 | Simonton et al. | |
| 5,172,529 | A | | 12/1992 | Van De Riet | |
| 5,212,918 | A | * | 5/1993 | Newhouse et al. | 52/126.3 |
| 5,214,885 | A | * | 6/1993 | Maas et al. | 52/71 |
| 5,255,478 | A | * | 10/1993 | Baranowski et al. | 52/36.1 |
| 5,346,296 | A | | 9/1994 | Kelley | |
| 5,429,432 | A | * | 7/1995 | Johnson | 312/235.3 |
| 5,513,574 | A | * | 5/1996 | Collins | 108/36 |
| 5,558,418 | A | | 9/1996 | Lambright et al. | |
| 5,584,546 | A | | 12/1996 | Gurin et al. | |
| 5,775,034 | A | * | 7/1998 | Logue | 52/36.1 |
| 5,860,713 | A | | 1/1999 | Richardson | |
| 5,878,673 | A | | 3/1999 | Kramer et al. | |
| 6,048,044 | A | * | 4/2000 | Biggel et al. | 312/258 |
| 6,070,956 | A | | 6/2000 | Yates | |
| 6,101,773 | A | | 8/2000 | Chau et al. | |
| 6,158,829 | A | | 12/2000 | Nielsen | |
| 6,241,329 | B1 | | 6/2001 | Nielsen | |
| 6,282,854 | B1 | * | 9/2001 | Vos et al. | 52/239 |
| 6,457,278 | B1 | * | 10/2002 | Fleming | 52/37 |
| 6,490,829 | B1 | * | 12/2002 | Schreiner et al. | 52/36.1 |
| 6,681,529 | B1 | * | 1/2004 | Baloga et al. | 52/29 |
| 2001/0017009 | A1 | * | 8/2001 | Lininger et al. | |
| 2002/0189505 | A1 | * | 12/2002 | Markofer | |

OTHER PUBLICATIONS

Commonly Assigned U.S. Appl. No. 09/881,521, filed Jun. 14, 2001, entitled Media Wall.

* cited by examiner

*Primary Examiner*—Carl D. Friedman
*Assistant Examiner*—Nahid Amiri
(74) *Attorney, Agent, or Firm*—Van Dyke, Gardner, Linn & Burkhart, LLP

(57) ABSTRACT

A workstation includes at least one vertical wall that is pivotable between an open and a closed position. In the closed position, wires that are behind the pivotable wall are concealed from view. In the open position, easy access is provided to the wires for re-arranging or changing the wires. The pivotable vertical wall includes at least one horizontal work surface that extends forwardly. A stationary vertical wall may be positioned adjacent the pivotable wall and may provide partial support for another horizontal work surface that extends forwardly from the stationary wall. The stationary wall may include a pivotable panel that allows easy access to wires positioned behind the stationary wall. A top shelf may extend across both the pivotable and stationary walls and include apertures positioned behind the plane defined by the two walls so that wires can be inserted through the apertures to the space behind the walls.

46 Claims, 12 Drawing Sheets

WORKSTATION WITH PIVOTING WALL

BACKGROUND OF THE INVENTION

The present invention relates to furniture workstations, and more particularly to furniture workstations that generally conceal wires and/or cables that may be used with the workstation.

In the past, a number of different types of desks and other pieces of furniture have been developed that allow cables and wires to be inserted into passageways and other structures in order to partially conceal such cabling from view. While such prior furniture successfully shields portions of the cables and wires from view, it is often difficult to thread the wires and cables through the passageways and other concealing portions of the furniture. Such difficulties are especially acute when changes in the cabling need to be made, particularly where such changes occur with a fair degree of regularity. As the number of electronic devices that are used in office environments has increased dramatically in the last several years, the necessity of managing the connecting cables for these devices has also increased. The need therefore exists for an aesthetically attractive piece of furniture that accommodates and conceals cabling and wires, and that also provides easy access to these wires and cables so that they can be easily changed or re-arranged.

SUMMARY OF THE INVENTION

Accordingly, the present invention provides an aesthetically attractive workstation that conceals cables and wires and which allows changes in such wiring and cabling to be easily implemented. Users of the workstation therefore are provided with a great degree of support and accommodation for the electronic equipment that they use with the workstation.

According to one aspect of the present invention, a workstation is provided that includes a first vertical wall and a second vertical wall positioned adjacent a side of the first wall. The first vertical wall further includes a horizontal work surface mounted to it that extends forwardly from the first wall. A hinge is also provided that allows the first vertical wall to pivot between an open and a closed position. In the closed position, the first and second vertical walls are generally coplanar. In the open position, the first wall is not coplanar with the second wall.

According to another aspect of the present invention, a workstation is provided that includes a pivotable vertical wall having a front and a back surface. A horizontal work surface is attached to, and extends forwardly from, the front surface of the pivotable vertical wall. A substantially horizontal shelf is positioned on top of the pivotable vertical wall and includes a first and a second portion. The first portion extends forwardly from a plane defined by the front surface of the pivotable vertical wall. The second portion extends rearwardly from a plane defined by the back surface of the pivotable vertical wall. The workstation further includes at least one aperture defined in the second portion of the shelf.

According to various other aspects of the present invention, the workstation may be constructed such that the pivoting wall is pivotable about a vertical pivot axis. A horizontal work surface that is at least partially supported by, and extends horizontally forward from, the second vertical wall may also be provided. The horizontal work surface on the first wall may itself be upwardly pivotable about a horizontal pivot axis. A shelf may be positioned on top of either the first or second vertical walls, or both. The shelf may include at least one aperture that is positioned rearwardly of the plane defined by the back surface of the pivotable wall. This aperture allows cabling from devices on the shelf to be passed through to the rear side of the pivotable vertical wall. The rear side of the pivotable vertical wall may include a number of wire-management structures, such as wire clips, cable troughs, and other devices.

A user of the workstation of the present invention finds that the management of the cables used by him or her in conjunction with electronic items placed on the workstation is especially easy. Electronic items such as laptops that are placed on the horizontal work surface of the pivotable wall are easily inserted through a large aperture in that wall. Because the wall is pivotable, access to these wires behind the wall is especially easy. Because of this easy access, the user can quickly connect these cables to power sources or other devices as necessary. After the appropriate connections are made, the pivotable wall is closed and the wire connections are all generally concealed. The workstation therefore provides a greater and more flexible amount of support for electronic items than was available in the past. These and other advantages of the invention will be apparent to one skilled in the art from the following specification when read in conjunction with the accompanying drawings.

DETAILED DESCRIPTION OF THE INVENTION

Figure 1:
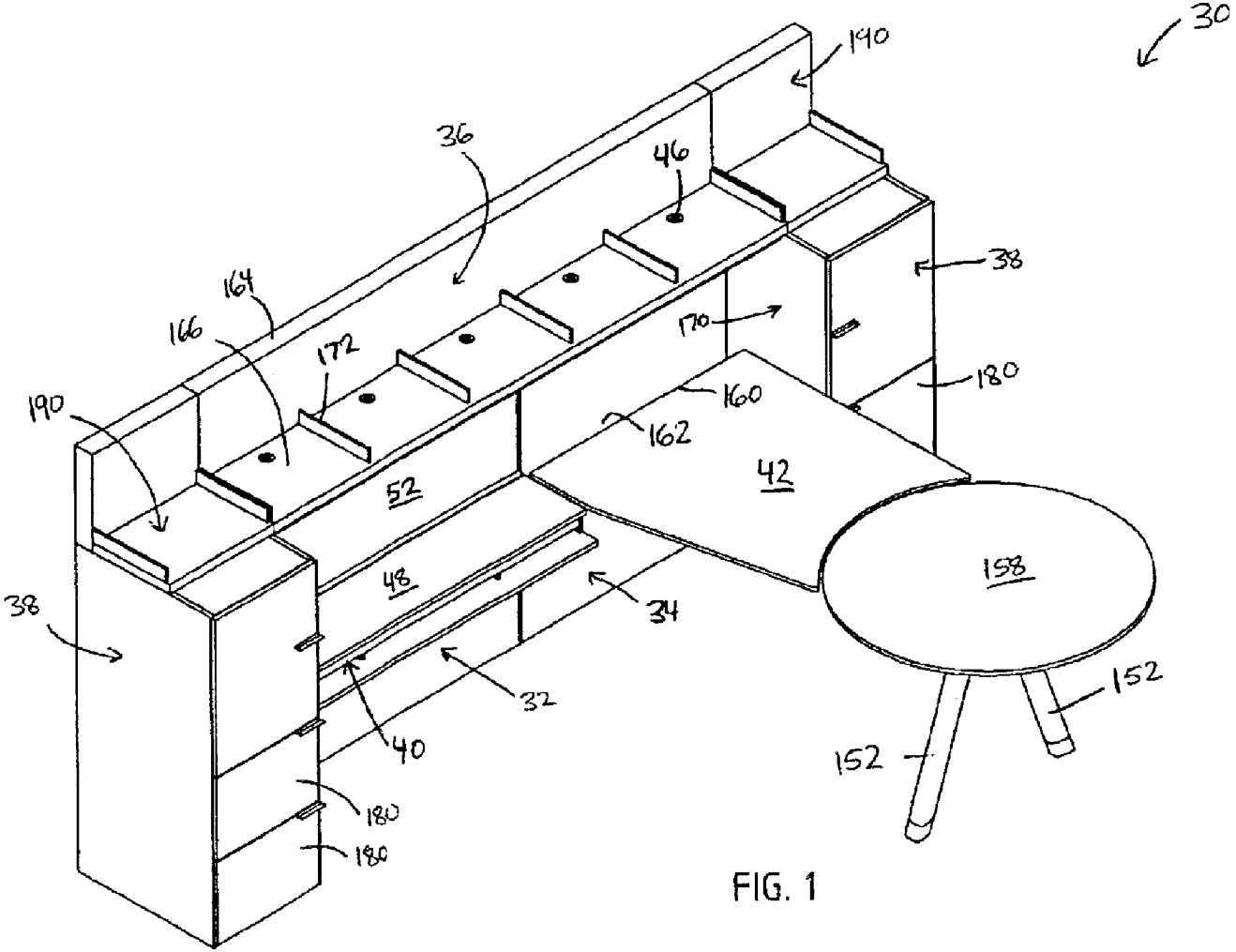
FIG. 1 is a perspective view of a workstation according to one aspect of the present invention.

The present invention will now be described with reference to the accompanying drawings wherein the reference numerals in the following written description correspond to like-numbered elements in the several drawings. A workstation 30 according to one embodiment of the present invention is depicted in FIG. 1. Workstation 30 generally includes a pivotable vertical wall 32, a stationary vertical wall 34, a top shelf 36, a cabinet 38 underneath each of the ends of top shelf 36, a technology console 40 attached to pivotable vertical wall 32, and a first horizontal work surface 42 extending forwardly from stationary vertical wall 34. The heights of technology console 40 and horizontal work surface 42 are such that a person sitting in a chair 44 (FIG. 2) can comfortably use these items for performing work. For example, a person may place an electronic device such as a laptop computer on the technology console 40 and use the computer while seated in chair 44. Workstation 30 is designed to easily accommodate the wires and cabling for the laptop computer, as well as any other type of electronic devices a person may use in conjunction with workstation 30. There are several different features of workstation 30 that allow easy accommodation of these wires and cables, and these will be described in more detail herein.

Figure 2:
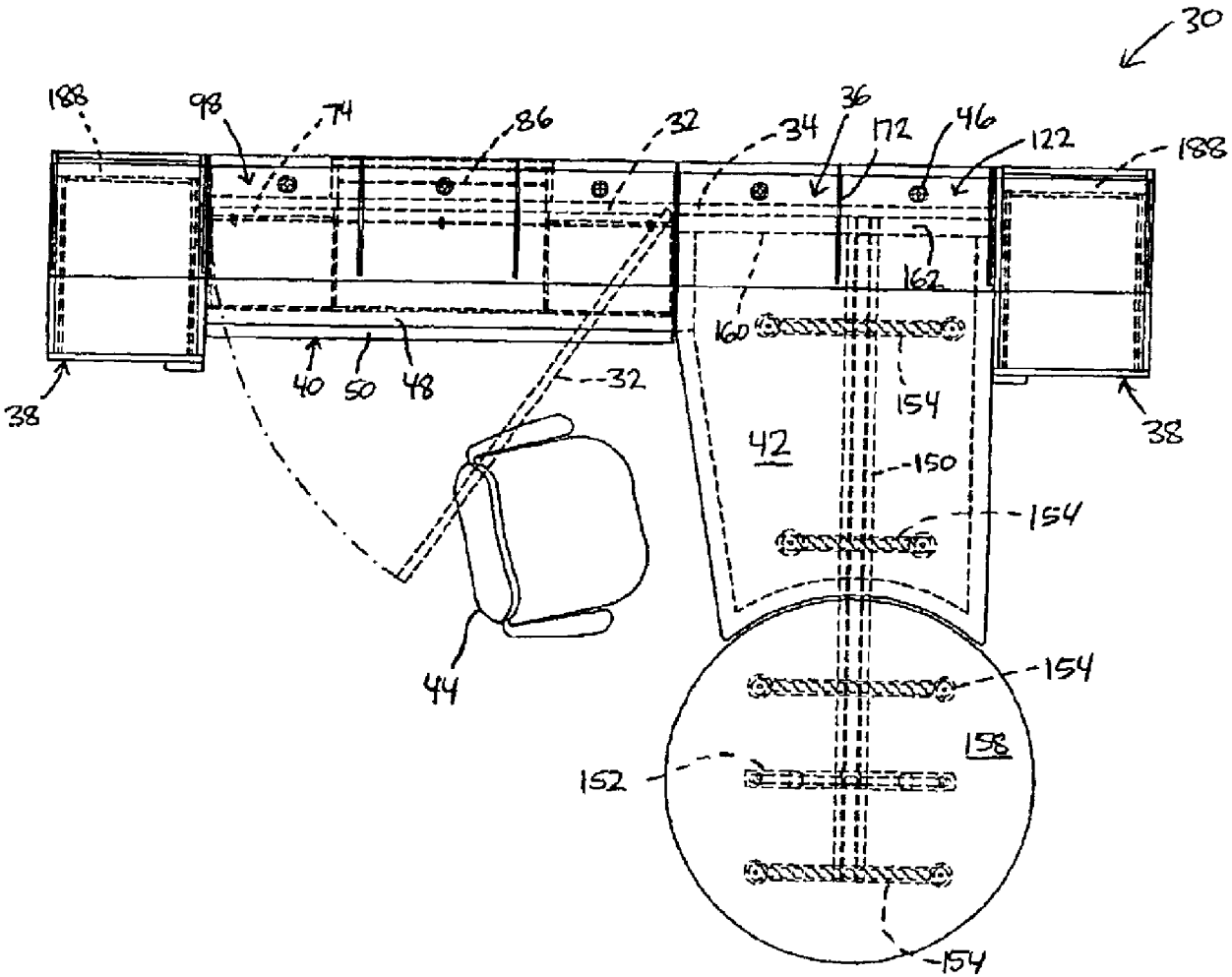
FIG. 2 is a plan view of the workstation of FIG. 1.
Figure 4:
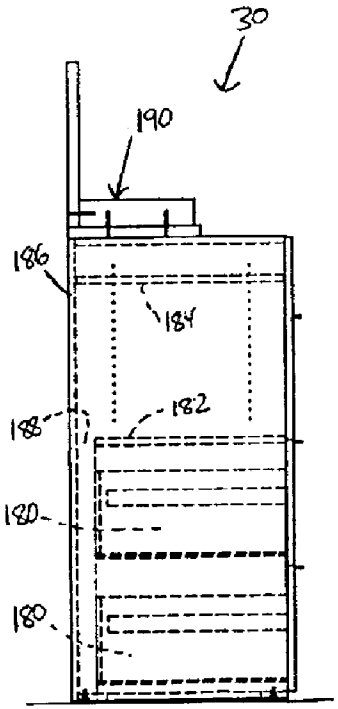
FIG. 4 is a side, elevational view of the workstation of FIG. 1.

One feature of workstation 30 that helps accommodate wires and cables, as well as allow easy access to them, is pivotable wall 32. Pivotable wall 32 is pivotable about a generally vertical axis, as is illustrated in FIG. 2. Wall 32 is generally pivotable between a closed position, such as that illustrated in FIG. 1, and an open position, such as that illustrated in phantom in FIG. 2. While not illustrated in FIG. 2, technology console 40 also moves when wall 32 is pivoted due to its fixed attachment to pivotable wall 32. The pivoting action of wall 32 allows a user of workstation 30 to easily access the space behind wall 32. As will be described more fully herein, this space may include a number of wire management features. The space is also connected to various other wire-handling devices, such as a plurality of grommets 46 fixed in shelf 36. The connection of this space to these various wire-handling devices is generally concealed from view by a user so that the wire-connections can be made in an aesthetically pleasing manner.

Figure 8:
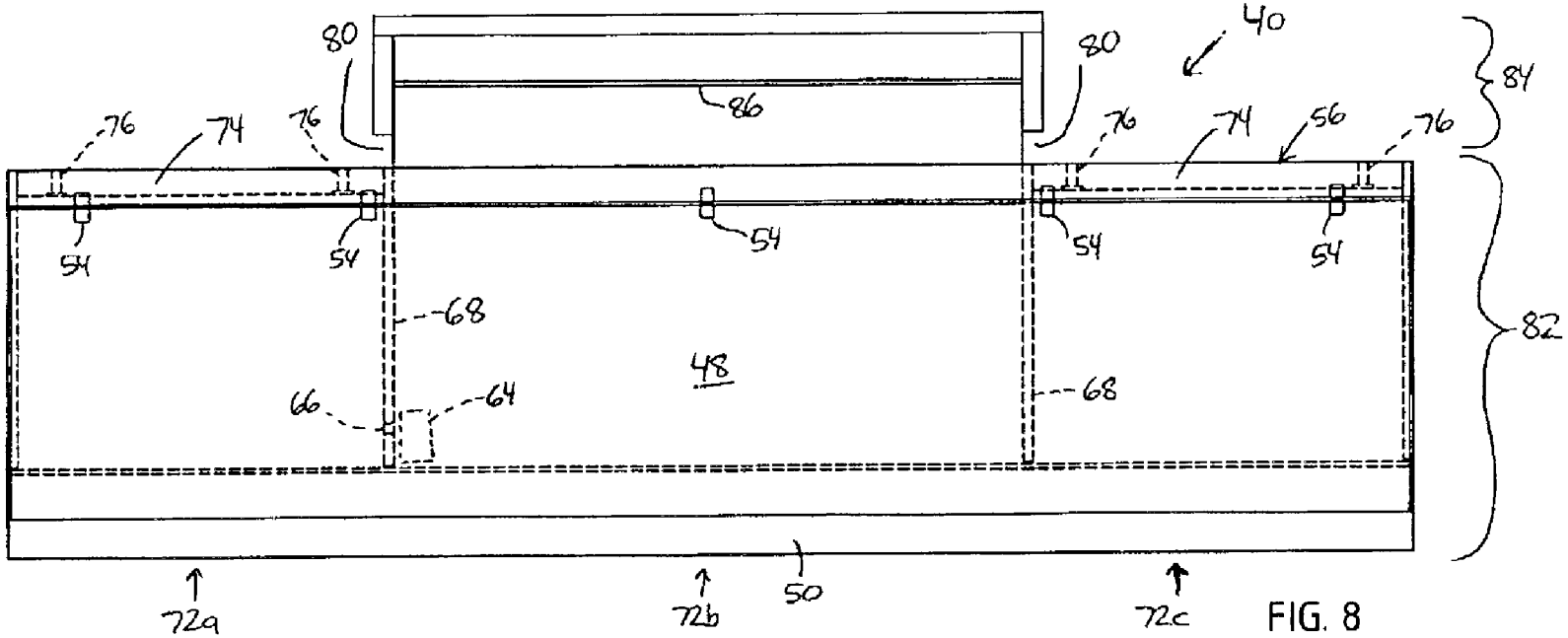
FIG. 8 is a plan view of the technology console of FIG. 7.
Figure 10:
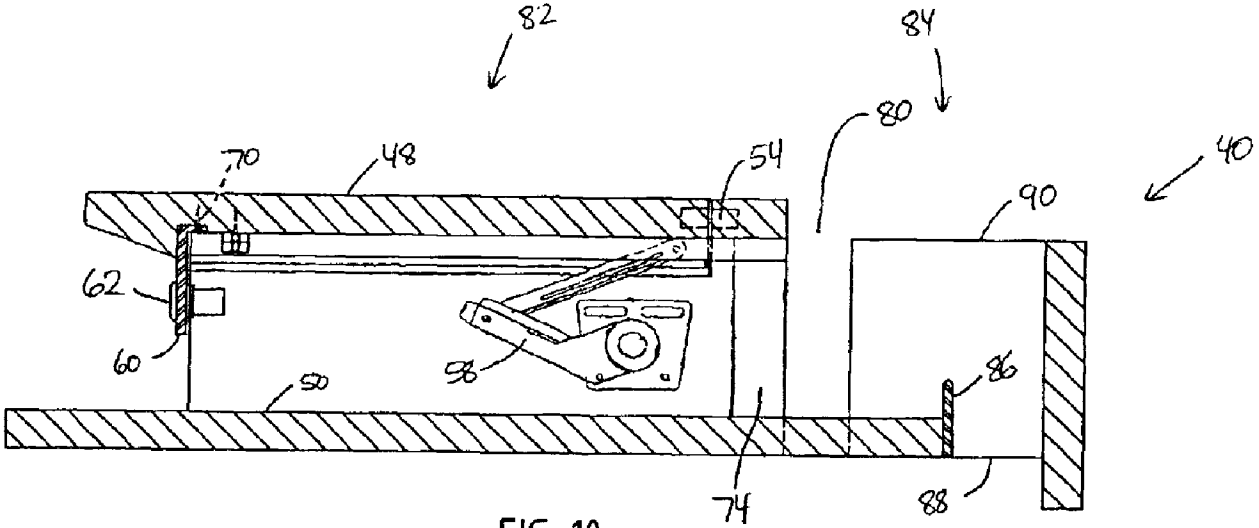
FIG. 10 is a sectional view of the technology console of FIG. 9 taken along the line X—X.

Technology console 40 generally includes an upper horizontal work surface 48 and a lower, parallel work surface 50. Both work surfaces 48 and 50 extend forwardly from a front surface 52 of pivotable wall 32. Lower work surface 50 may extend forward a greater amount than upper work surface 48, although the relative forward extension of these two work surfaces can be varied from that depicted herein. While any dimensions may be used, work surfaces 48 and 50 preferably extend forward about 10 to 14 inches. Upper work surface 48 is preferably upwardly pivotable about a generally horizontal pivot axis. This upward pivoting of upper surface 48 is illustrated in phantom in FIG. 6. The upward pivoting may be accomplished in any known manner. In the illustrated embodiment, a plurality of concealed barrel hinges 54 are attached to internal bores in the back end of upper surface 52 and a frame 56 of console 40 (FIGS. 8 & 10). A conventional stay 58 may also be attached to frame 56 of console 40. Stay 58 is adapted to generally retain upper surface 48 in its upward position after having been pivoted upwardly. This frees a user's hand from having to hold upper surface 48 in its upward position at all times, and thus facilitates access to items positioned on lower work surface 50.

Figure 9:
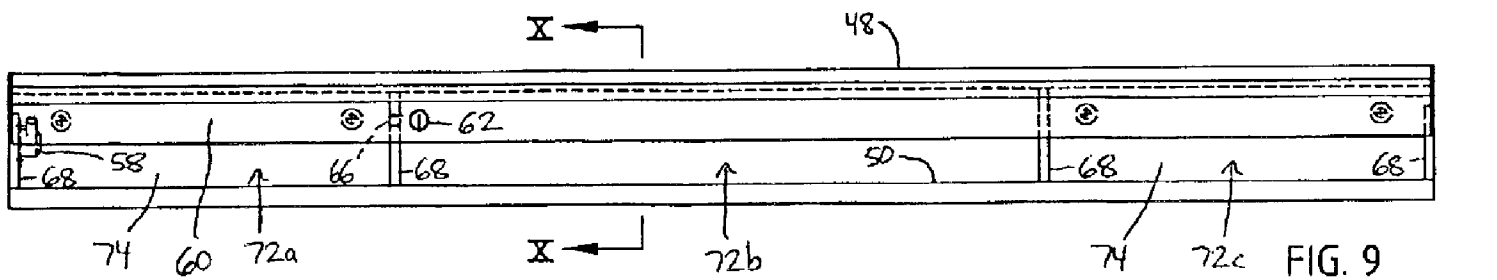
FIG. 9 is a front, elevational view of the technology console of FIG. 8.

A valance 60 is attached to the underside of upper work surface 48 generally along the front edge of work surface 48 by way of one or more pins 70 (FIGS. 3–11). Valance 60 extends downwardly from upper work surface 48 toward lower work surface 50. While in the illustrated embodiment valance 60 extends only about halfway down to lower work surface 50, the downward extent of valance 60 can be varied, and valance 60 could extend all the way into contact with lower work surface 50. A keyhole 62 is defined in valance 60 and receives a key used to lock and unlock a lock 64 (FIG. 8). Lock 64 selectively prevents upper work surface 48 from being pivoted upwardly to the position shown in phantom in FIG. 6. Lock 64 includes a bolt or other extension (not shown) that is selectively turned or inserted into an aperture 66 defined in a divider panel 68 (FIGS. 8–9). When so inserted, upper surface 48 is prevented from being pivoted upward by the latching of the bolt or extension within aperture 66. Lock 64 therefore can be used to partially secure items placed between upper and lower work surfaces 48 and 50. This securement may only be partial because any items which are smaller than the distance between lower surface 50 and the bottom of valance 60 can be removed regardless of whether lock 64 is locked or not. Therefore, valance 60 preferably extends downwardly a sufficient distance such that standard laptop computers will not be able to fit through the space between the bottom of valance 60 and lower surface 50. Lock 64 can therefore be used to secure laptop computers and other items of similar height between upper and lower surfaces 48 and 50.

Figure 11:
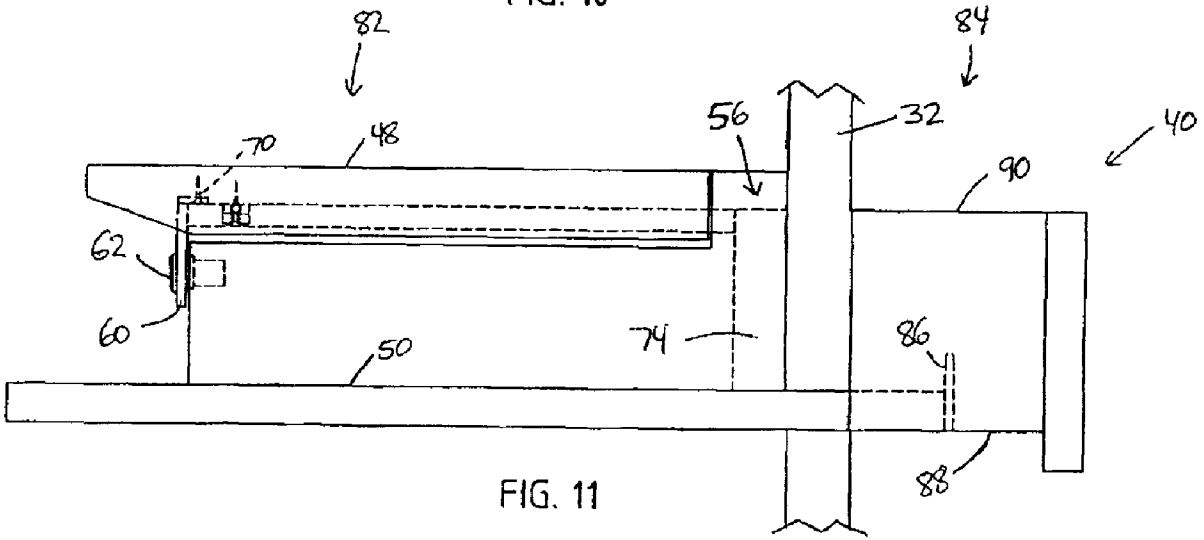
FIG. 11 is a side, elevational view of the technology console of FIG. 8.

As noted, console 40 includes one or more divider panels 68 that are attached to lower work surface 50. In the illustrated embodiment there are four divider panels 68 that divide the space between upper and lower surfaces 48 and 50 into three sections 72*a, b*, and *c*. The center section 72*b* preferably spans a width that can accommodate standard laptop computers, keyboards, and other common electronic components. A back panel 74 is attached to the rear of console 40 behind sections 72*a* and *c*. Back panel 74 extends from lower surface 50 up to upper surface 58. Each back panel 74 includes one or more fastener apertures 76 which receive screws, bolts, or other types of fasteners that secure back panels 74, and thus the entire console 40, to pivotable wall 32. Pivotable wall 32 fits into a space 80 defined between a front portion 82 and a rear portion 84 of console 40 (FIGS. 10–11). Preferably, center section 72*b* does not include any back panel 74 and pivotable wall 32 includes an aperture defined precisely at the location where a back panel for center section 72*b* would otherwise be positioned. This aperture and the lack of a back panel in section 72*b* means that there is no obstruction in center section 72*b* between front and rear portions 82 and 84 of console 40. Thus, the wires and cables from a laptop or other electronic device on lower surface 50 can extend from front portion 82 through the aperture in pivotable wall 32 to the rear portion 84 of console 40. The rear portion 84 of console 40 is positioned behind pivotable wall 32 and thus cannot be seen by a viewer when pivotable wall 32 is in its closed position. From the rear portion 84 of console 40, the wires and cables can be extended into various other parts of workstation 30, as will be described more herein.

Figure 5:
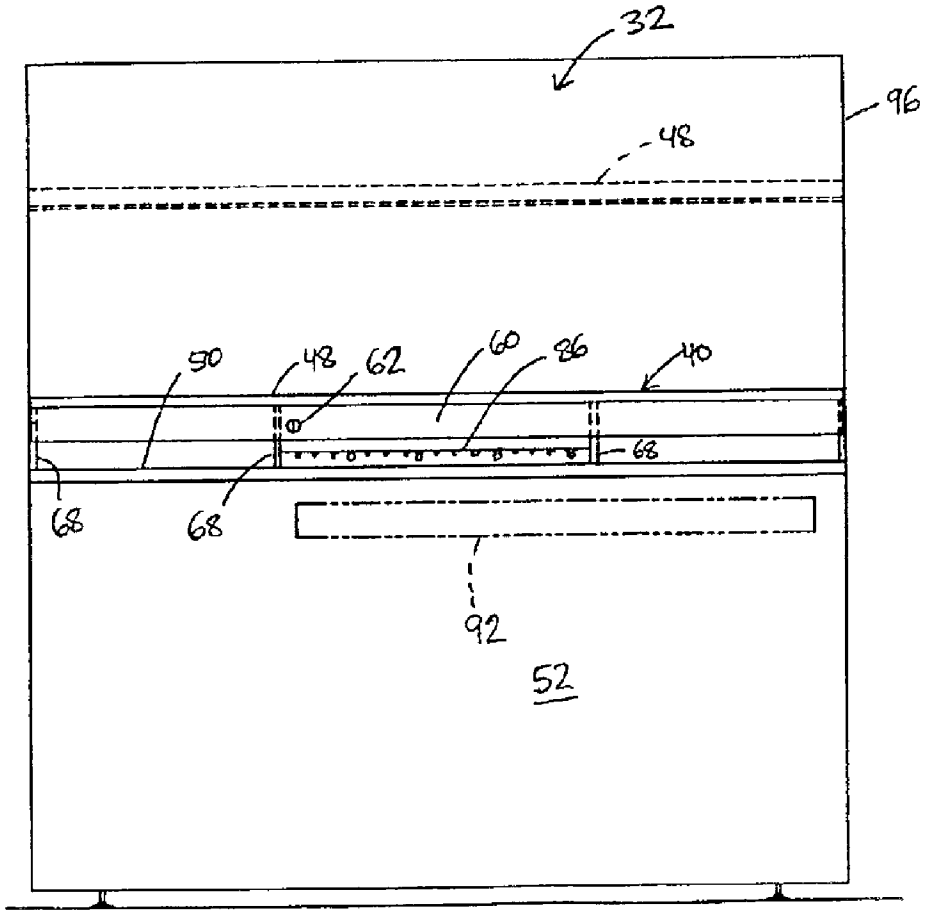
FIG. 5 is a front, elevational view of a pivotable wall according to one aspect of the present invention.
Figure 7:
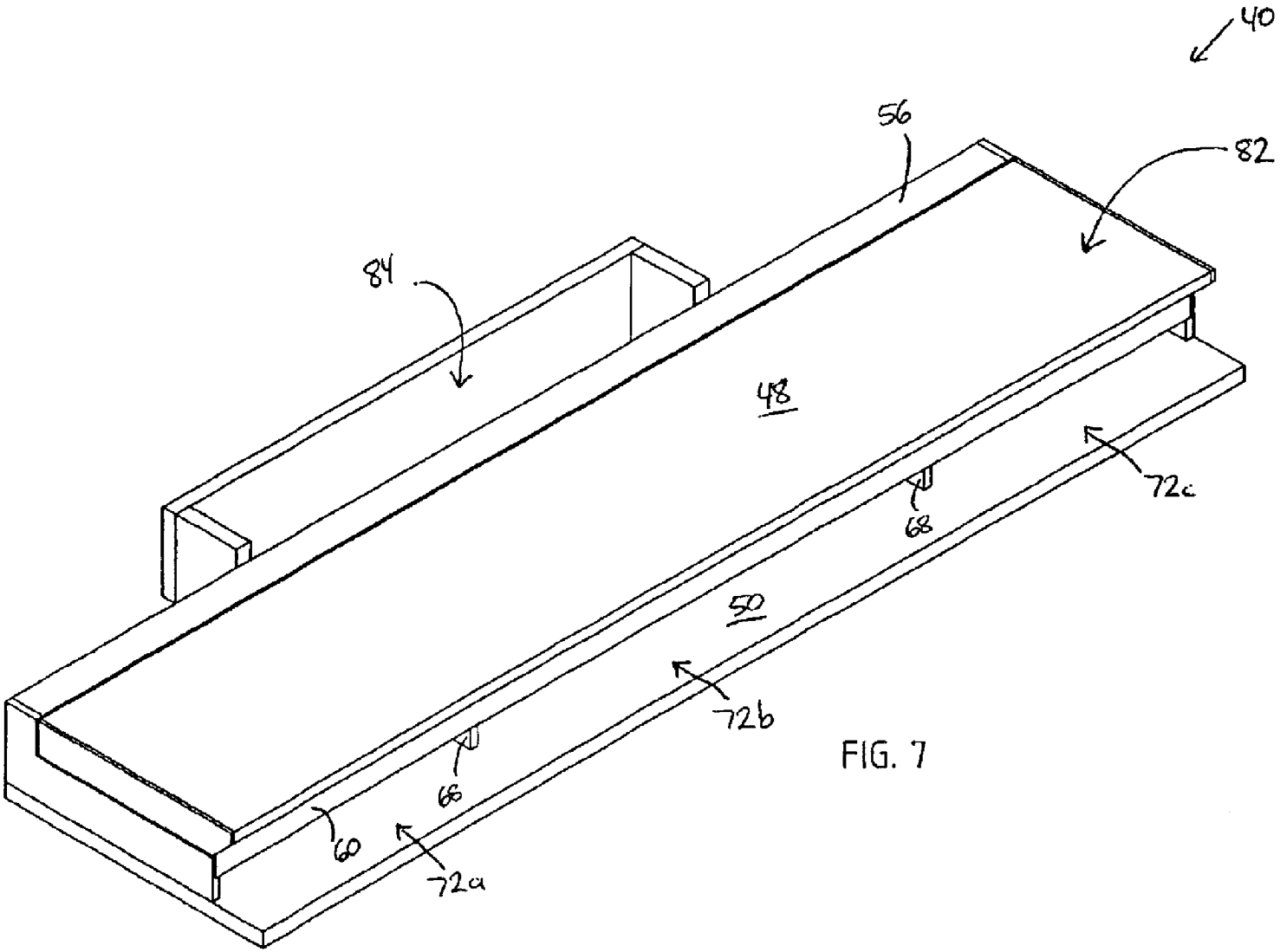
FIG. 7 is a perspective view of a technology console attached to the pivotable wall of FIG. 5.

In order to help secure and manage the wires and cables that extend from front portion 82 of console 40 to rear portion 84, rear portion 84 may include a conventional wire management edge 86 positioned at the rear end of center section 72*b* (shown in FIG. 5, but not FIG. 9). Wire management edge 86 includes a plurality of horizontally spaced holes defined in flexible material. The holes are sized to generally accommodate one or more standard diameter cables and wire. A cut adjacent each hole extends from the hole to the top of the edge and thereby allows a cable to be easily inserted into the hole. Due to the size of the hole and the general flexibility of the material of edge 86, the cables and wires inserted into edge 86 are held in place, yet easily removed by a user. While other constructions may be used, wire management edge 86 may be made from a piece of sheet metal with the appropriate cuts made along it top edge. The sheet metal may then be coated with a layer of plastisol to provide a soft exterior that helps grip the wires inserted into the holes.

Rear portion 84 of console 40 includes a bottom aperture 88 (FIG. 8) through which wires and other cables may be inserted for making connections to other cables and wires, power outlets, telephony jacks, and other items. Rear portion 84 of console 40 also includes an upper aperture 90 defined generally above bottom aperture 88 (FIGS. 10-11). Upper aperture 88 allows cables and wires to be inserted therein for making connections to other items that may be positioned above console 40. For example, it may be desirable to have a cable or wire connection between an electronic item on console 40 and an item positioned on shelf 36. Such a connection can be carried out by running the wire from the front portion 82 of console 40 into the back portion 84 of console 40, through upper aperture 90, and then upwardly behind pivotable wall 32 into a selected one of the grommets 46 in shelf 36. The placement of this wire is easily carried out by pivoting wall 32 to its open position, installing the wire as desired, and then pivoting wall 32 back to its closed position.

Figure 6:
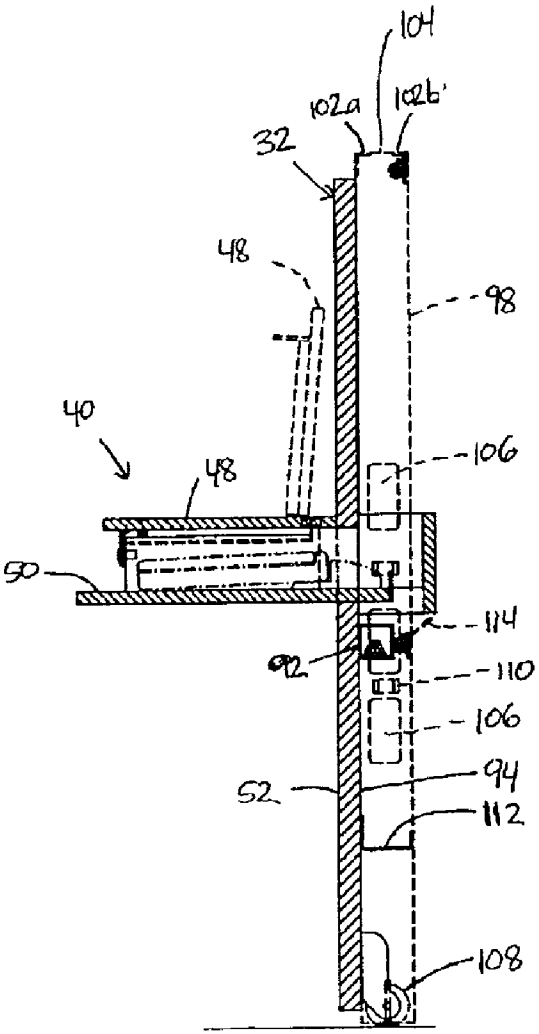
FIG. 6 is a side, elevational view of the pivotable wall of FIG. 5.

In order to further facilitate the management of wires behind pivotable wall 32, a wire management channel 92 is secured to a back surface 94 of pivotable wall 32 (FIGS. 5–6). Wire management channel 92 may be a conventional wire management channel, such as, for example, one sold by Dek Cable Accessories, Inc. of St. Charles, Ill., under part no. 046-2020SBP. Other types of channels, of course, can be used. Wire management channel 92 helps hold and organize wires that run from rear portion 84 of console 40 towards a pivot axis side 96 of pivotable wall 32. Pivot axis side 96 of wall 32 is the side of wall 32 that is hinged, as will be described more below. Wires positioned behind wall 32 are preferably run toward pivot axis side 96 so that when pivotable wall 32 is opened, any pre-existing wire or wires are only minimally impacted by the opening of pivotable wall 32. In other words, the wires and cables already behind wall 32 will only minimally be stretched or pulled, if at all, if they are threaded toward pivot axis side 96 and then run vertically, as necessary, adjacent side 96.

Figure 13:
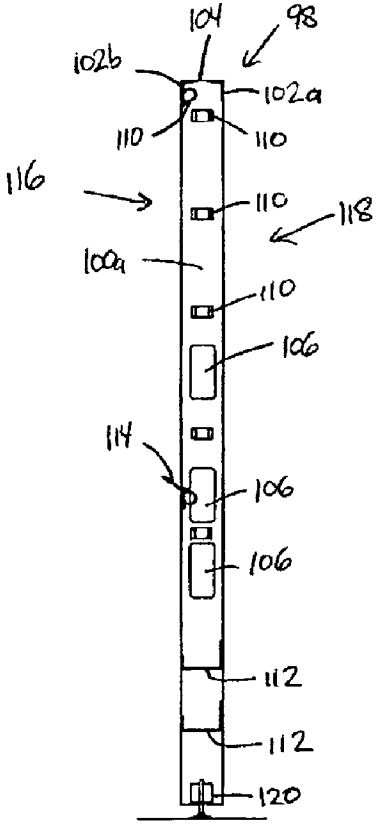
FIG. 13 is a side, elevational view of the support frame of FIG. 12.
Figure 12:
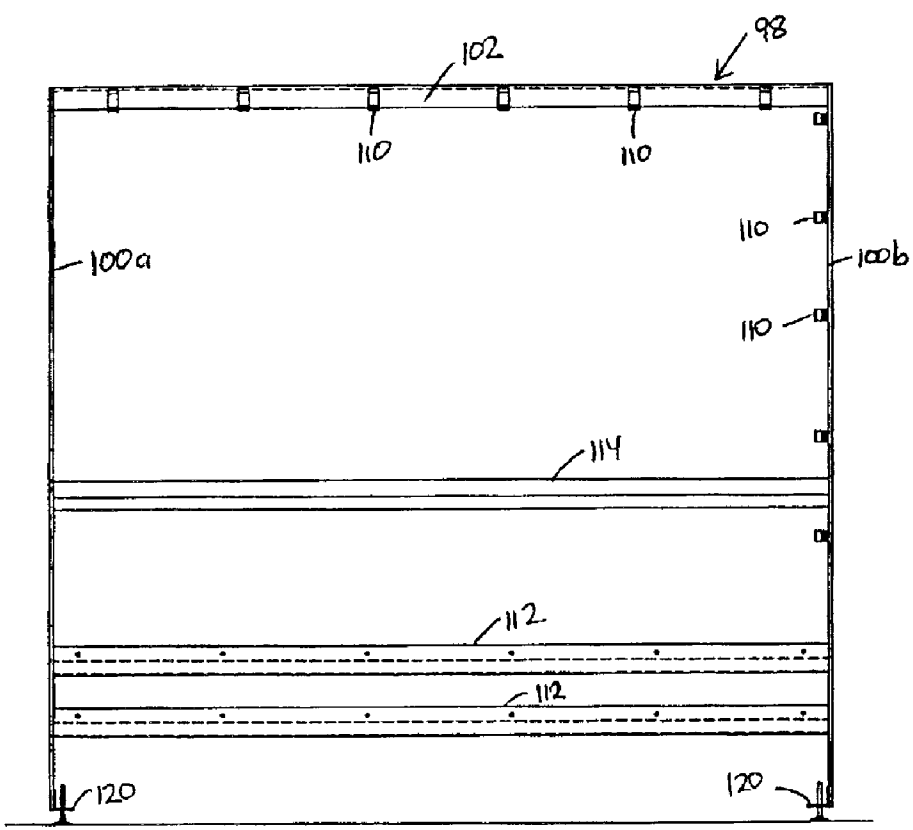
FIG. 12 is a front, elevational view of a support frame according to one aspect of the present invention.
Figure 14:
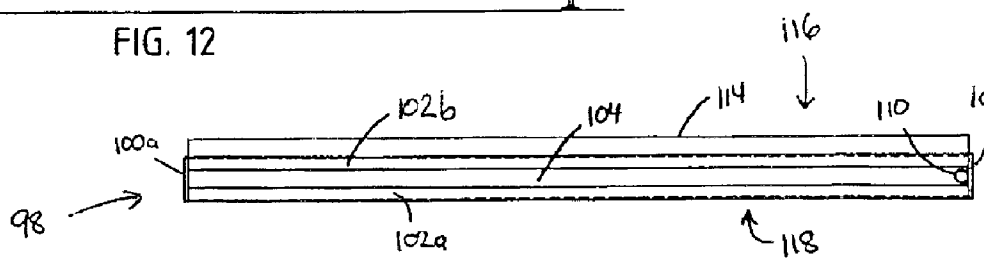
FIG. 14 is a plan view of the support frame of FIG. 12.

In the illustrated embodiment, pivotable wall 32 is secured to, and supported by, a frame 98 (FIGS. 6 & 12–14). Frame 98 is generally shaped, when viewed from the front, the same as pivotable wall 32. Frame 98 includes a first and second vertical side piece 100*a* and *b*, which are made of a suitably strong material to support pivotable wall 32, such as steel. A pair of angled cross beams 102*a* and *b* extend horizontally across the tops of side pieces 100*a* and *b*. Beams 102*a* and *b* may also be made of steel. Beams 102*a* and *b* are separated from each other by an elongated aperture 104 that allows cables and wires to be run vertically out of the top of frame 98, such as into one or more of grommets 46 (FIGS. 13–14). Side pieces 100*a* and *b* also each define a plurality of apertures 106 that allow cables and wires to be strung out of the sides of frame 98 into adjacent structures, as will be described more herein. A plurality of vertically arranged hinges (not shown) have one of their ends attached to side piece 100*b* and their other end attached to pivotable wall 32 along its pivot axis side 96. These hinges allow pivotable wall 32 to pivot about a generally vertical axis. The hinges may be any conventional type of hinge. A roller 108 is attached to rear surface 94 of pivotable wall 32 and helps support wall 32 on the ground during its pivoting motion (FIG. 6). In order to help ensure that frame 98 is installed in a level condition, side pieces 100*a* and *b* each may include a conventional height adjusting L-bracket 120 attached to their bottom ends (FIG. 12).

In order to help support and accommodate the wires and cables that may be run through frame 98, frame 98 includes a number of wire management features. One of these features is the inclusion of a number of wire clips 110. Wire clips 110 may be attached to side piece 100*b* and the rearward cross beam 102*b*. Wire clips 110 help organize and secure the wires in place. Wire clips 110 may be any conventional wire clip, such as, for example, wire clips sold by Dek Cable Accessories, Inc. of St. Charles, Ill., under part no. 023-0750. Another wire management feature is a pair of horizontal wire management troughs 112 that extend between side pieces 100*a* and *b*. Wire management troughs hold and support horizontally running wires and cables. An optional angled plate 114 also helps facilitate the setup of wires and cables. Angled plate 114 extends horizontally between side pieces 100*a* and *b*. Angled plate 114 extends outwardly from a rear 116 of frame 98. From rear 116, angled plate 114 extends downwardly toward a front 118 of frame 98 (FIGS. 12–13). Angled plate 114 helps deflect cables and other wires that are dropped through grommets 46, as well as aperture 104, toward a user of workstation 30. This makes it easier for the user to install the wires in the desired manner.

Depending on the intended application of workstation 30, frame 98 may or may not include a concealment panel attached to its rear side 116. If such a concealment panel is used, angled plate 114 would be removed. The concealment panel itself would ensure that wires and cables dropped through aperture 104 were kept within the interior of frame 98. The concealment panel would generally be used where workstation 30 was going to be used in the middle of a room, or in some other environment where the rear side 116 of frame 98 was visible to passersby, rather than being placed immediately adjacent a room wall or other sight-blocking obstruction. The concealment panel, when used, would cover the entire back side 116 of frame 98, as well as the back side of an adjacent frame 122, and would preferably be finished in a manner aesthetically coordinated with the rest of workstation 30.

Figure 16:
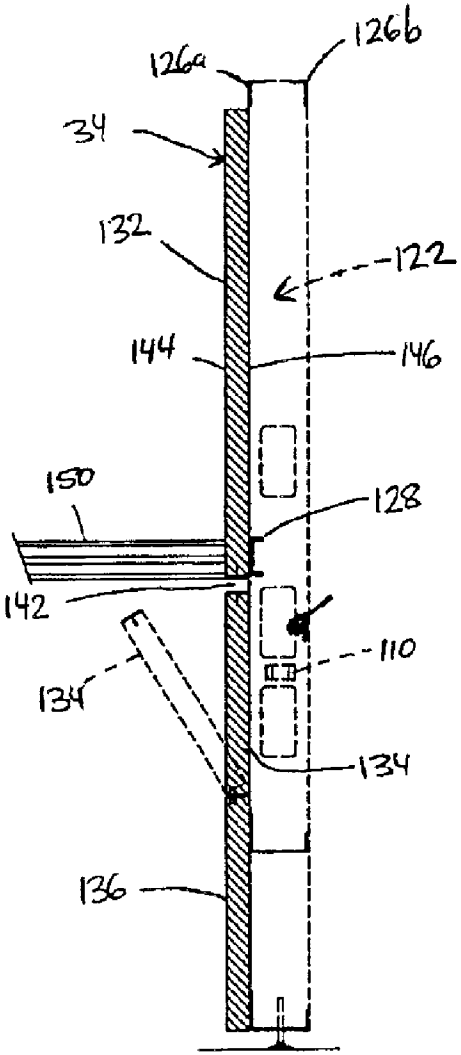
FIG. 16 is a side, elevational view of the second vertical wall of FIG. 15.
Figure 15:
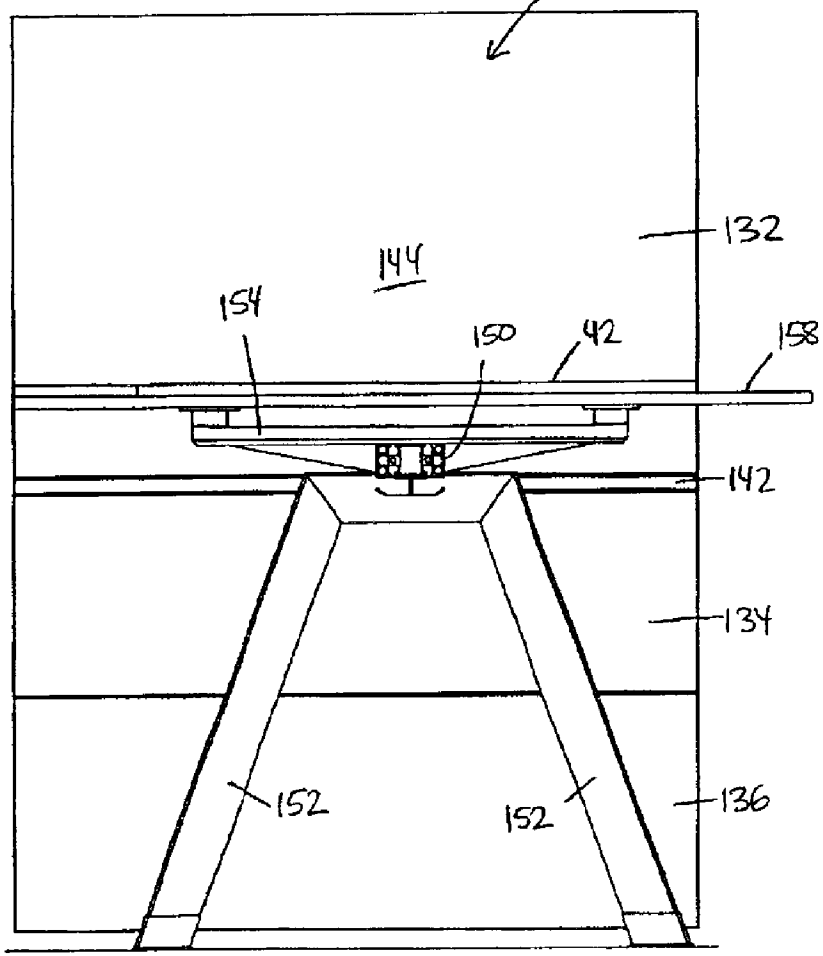
FIG. 15 is a front, elevational view of a second vertical wall and horizontal work surface according to one aspect of the present invention.
Figure 19:
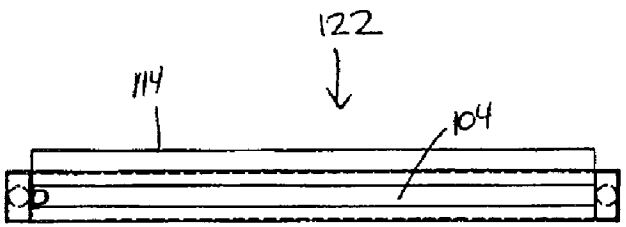
FIG. 19 is a plan view of the second support frame assembly of FIG. 17.
Figure 18:
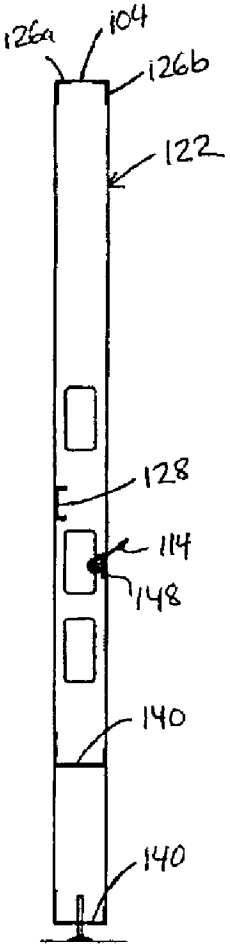
FIG. 18 is a side, elevational view of the second support frame assembly of FIG. 17.
Figure 17:
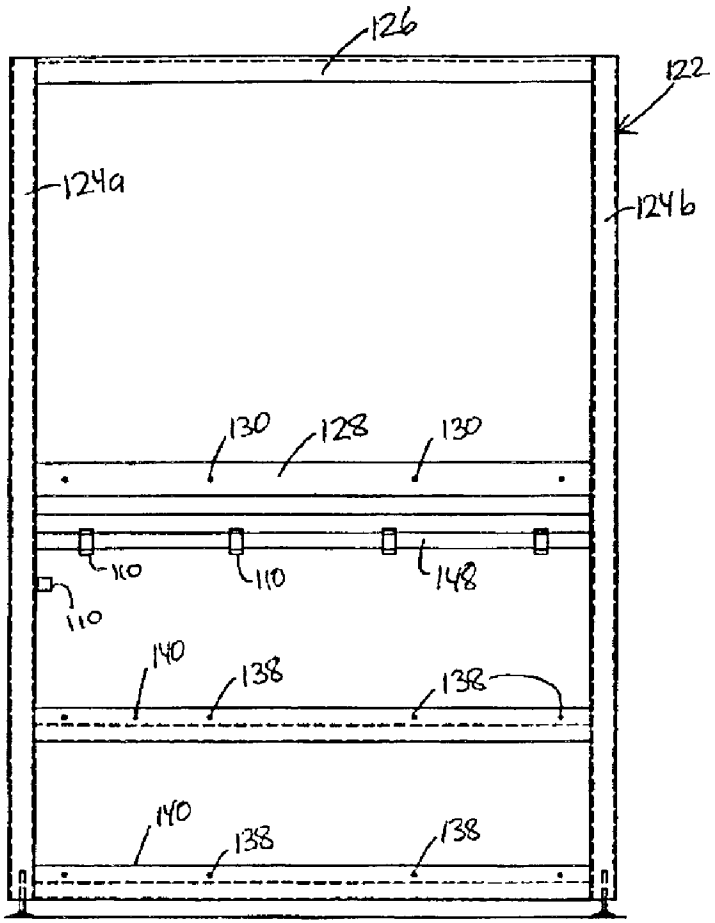
FIG. 17 is a front, elevational view of a second support frame assembly.

Stationary wall 34, which is positioned alongside pivotable wall 32, may be composed of a plurality of sections. In the illustrated embodiment, stationary wall 34 includes a top section 132, a pivotable panel 134, and a bottom section 136 (FIGS. 15–16). Stationary wall 34, like pivotable wall 32, is supported by a frame 122 (FIGS. 16–18). Frame 122 includes a pair of side pieces 124*a* and *b*, as well as a pair of cross beams 126*a* and *b* that extend horizontally across the tops of side pieces 124*a* and *b*. The side pieces 124 include a plurality of apertures 106, and the cross pieces define another elongated aperture 104. An attachment bracket 128 extends horizontally between side pieces 124*a* and *b*. Attachment bracket 128 includes a plurality of fastener holes 130 (FIG. 17) that receive fasteners that help attach top section 132 of stationary wall 34 to frame 122. Bottom section 136 of stationary wall 34 is attached to frame 122 by way of fasteners inserted through fastener holes 138 defined in a pair of horizontally extending cable troughs 140 (FIG. 17). Cable troughs 140, as well as attachment bracket 128, are secured to side pieces 124*a* and *b* by any conventional means, such as by welding.

Pivotable panel 134 is hingedly attached on top of bottom section 136 of stationary wall 34. While any type of hinging may be used, concealed hinges, such as barrel hinges, are preferably used. Pivotable panel 134 pivots between an open position (shown in phantom in FIG. 16) and a closed position. Pivotable panel 134 preferably is vertically dimensioned such that a small gap 142 is defined between the upper edge of pivotable panel 134 and the bottom of top section 132 when pivotable panel 134 is closed. Gap 142 allows cables and wires to extend between a front side 144 and a rear side 146 of stationary wall 34 when pivotable panel 134 is closed. Wires that extend into the rear side 146 of stationary wall 34 may be supported in the upper cable trough 140 as well as clipped to wire clips 110. Wire clips 110 may be attached to a horizontal bar 148, as well as to one or more of side pieces 124.

A work surface support beam 150 is attached to the lower end of top section 132 of stationary wall 34 (FIGS. 15–16). This attachment supports support beam 150 at one end, while a pair of legs 152 support support beam 150 at its opposite end. Support beam 150 includes a plurality of attached gussets 154 that support one or more work surfaces. In the illustrated embodiment, gussets 154 support a first and second work surface 42 and 158, respectively (FIGS. 1 & 2). First work surface 42 may be positioned at a higher height than second work surface 158, and first work surface 42 may have a wooden, opaque finish on it while second work surface 158 may be made of glass or other transparent material. Other constructions of these work surfaces are, of course, possible. First work surface 42 includes a rear edge 160 that is spaced away from stationary wall 34 a small amount. This space creates a gap 162 that allows cables and wires from items placed on work surfaces 42 and 158 to be run along these work surfaces toward rear edge 160, through gap 162, and, if desired, into gap 142 above pivotable panel 134. From there, these cables and wires could be run to one of the grommets 46 above stationary wall 34. Alternatively, the cable and wires could be inserted through one of the apertures 106 in side piece 124*a* of frame 122 into a corresponding aperture 106 in the adjacent side piece 100*b* of frame 98. From here, the cables and wires could be run to technology console 40, or to one of the grommets 46 above pivotable wall 32.

Figure 22:
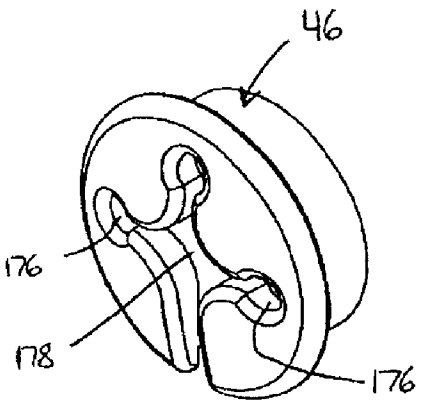
FIG. 22 is a perspective view of a grommet according to one embodiment of the present invention.
Figure 21:
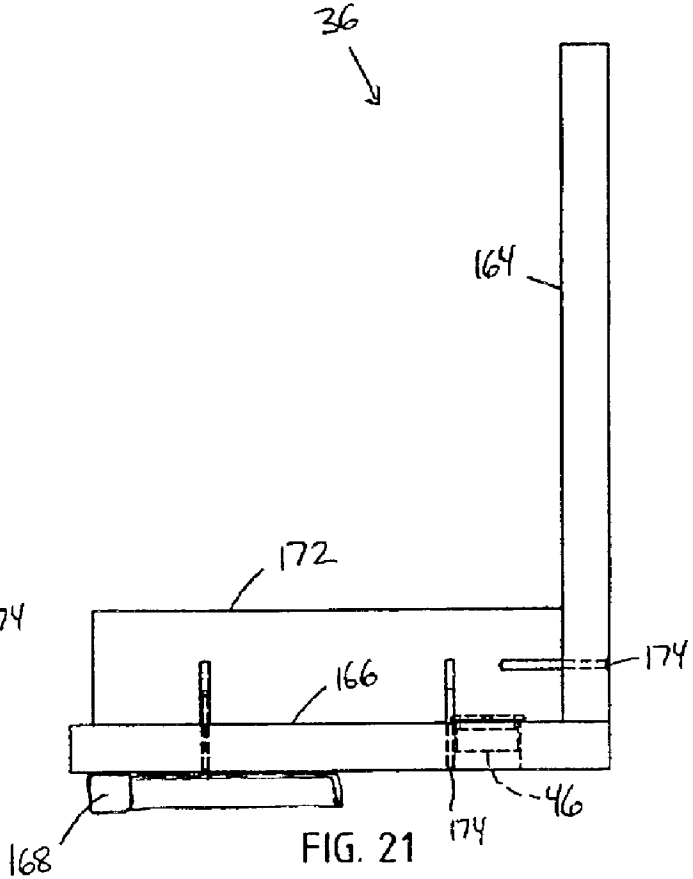
FIG. 21 is a side, elevational view of the shelf of FIG. 20.
Figure 20:
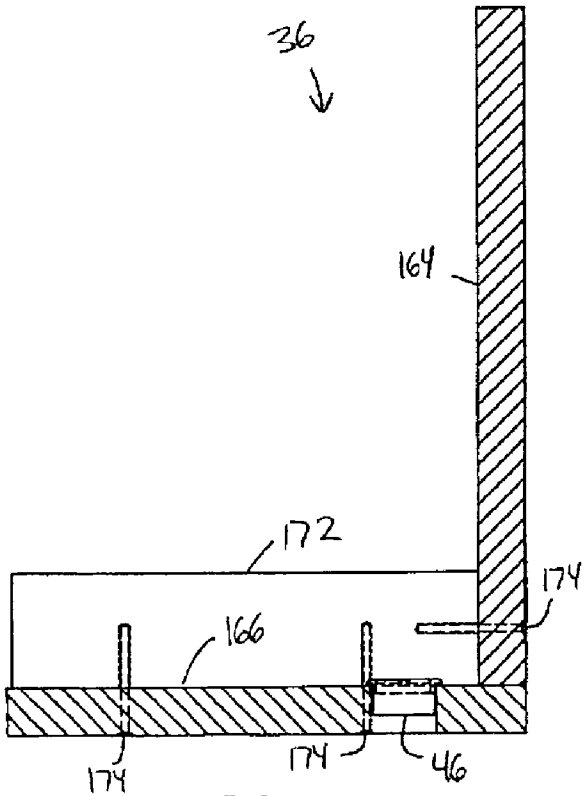
FIG. 20 is a sectional view of a shelf according to one embodiment of the present invention.

Shelf 36 includes a generally vertical back panel 164 and a generally horizontal lower panel 166 (FIGS. 20–21). Shelf 36 preferably extends all the way from side piece 100*a* of frame 98 to side piece 124*b* of frame 122. Shelf 36 thus extends completely across both pivotable wall 32 and stationary wall 34. Shelf 36 is supported by one or more valances 168 positioned underneath, and attached to, lower panel 166. If two valances 168 are used, each valance 168 extends under lower panel 166 for a portion of shelf 36's length sufficient to support its weight. Regardless of the number of valances used, each valance 168 is attached to an interior side panel 170 on each of cabinets 38. This attachment supports valance 168 and shelf 36. Shelf 36 may include a number of divider panels or fins 172 spaced along the length of shelf 36. Fins 172 are secured to lower panel 166 and back panel 164 by way of one or more pins 174. Lower panel 166 includes a number of apertures into which are inserted grommets 46. Grommets 46 help support wires and cables that are inserted through these apertures. While any conventional grommet can be used (or even no grommet), FIG. 22 illustrates one example of a grommet 46 that is suitable for use in these apertures. Grommets 46 are made of a flexible material, such as Santoprene®, which is a thermoplastic elastomer marketed by the Monsanto Company of St. Louis, Mo. Grommet 46 includes three circular apertures 176 that are dimensioned to grip and hold cables inserted therein. By moving the cables to an open, center portion 178, the cables or wires can be easily removed from grommet 46. Grommets 46 are preferably positioned in lower panel 166 such that center portion 178 is directly overhead elongated apertures 104 defined in the tops of frames 98 and 122. Cables and wires in grommets 46 can thus be inserted through apertures 104 where they are easily accessible through either the pivoting of pivotable wall 32 or the opening of pivotable panel 134.

Figure 24:
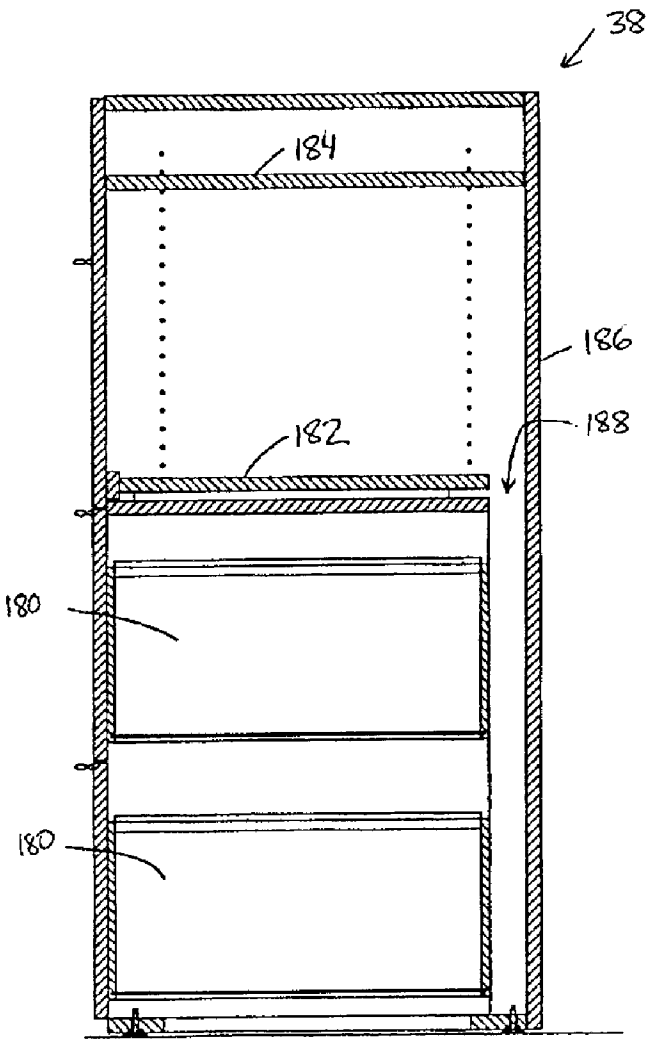
FIG. 24 is a side, sectional view of the cabinet of FIG. 23.
Figure 23:
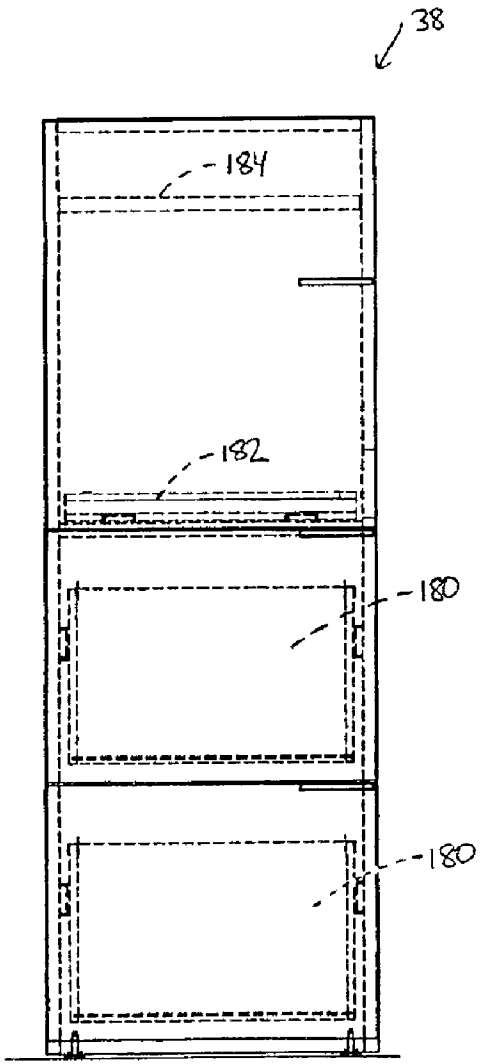
FIG. 23 is a front, elevational view of a cabinet according to one embodiment of the present invention.

Cabinets 38 may be positioned on either end of pivotable and stationary walls 32 and 34. Cabinets 38 each include an interior side panel 170 to which shelf valance 168 is attached. In the illustrated embodiment, each cabinet 38 includes a plurality of drawers 180 (FIGS. 23–24). A stationary shelf 182 and an adjustable shelf 184 may be positioned above drawers 180 in cabinet 38. Preferably, drawers 180 and stationary shelf 182 do not extend all the way back to a rear panel 186 of cabinet 38. By not extending all the way back to rear panel 186, a gap 188 is created in the back of cabinet 38. Gap 188 allows wires and cables from items stored in each drawer 180 and on stationary shelf 182 to be interconnected in a concealed manner. Furthermore, interior side panel 170 of cabinet 38 preferably includes at least one aperture generally aligned with the one or more apertures 106 of the adjacent frame side piece, which will either be side piece 100*a* or side piece 124*b*. Cables and wires from items with cabinets 38 can therefore be inserted into the interiors of frames 98 and 122 for interconnections with other items as desired. Each cabinet 38 may also preferably include a top shelf 190 on its top that matches, and is contiguous with, top shelf 36.

It will be understood that the style and size of each cabinet 38 can be varied significantly from that depicted in the attached drawings. In fact, cabinets 38 can be replaced entirely with any structure that extends forwardly a sufficient distance to provide suitable stability to walls 32 and 34 and their associated frames. For example, one or more of cabinets 38 could be replaced with a simple end panel that is approximately the same size as, or smaller than, the interior side panels 170 of cabinets 38. As another alternative, one or both of cabinets 38 could be replaced with a credenza or a forwardly extending return. Other structures are also possible.

Figure 3:
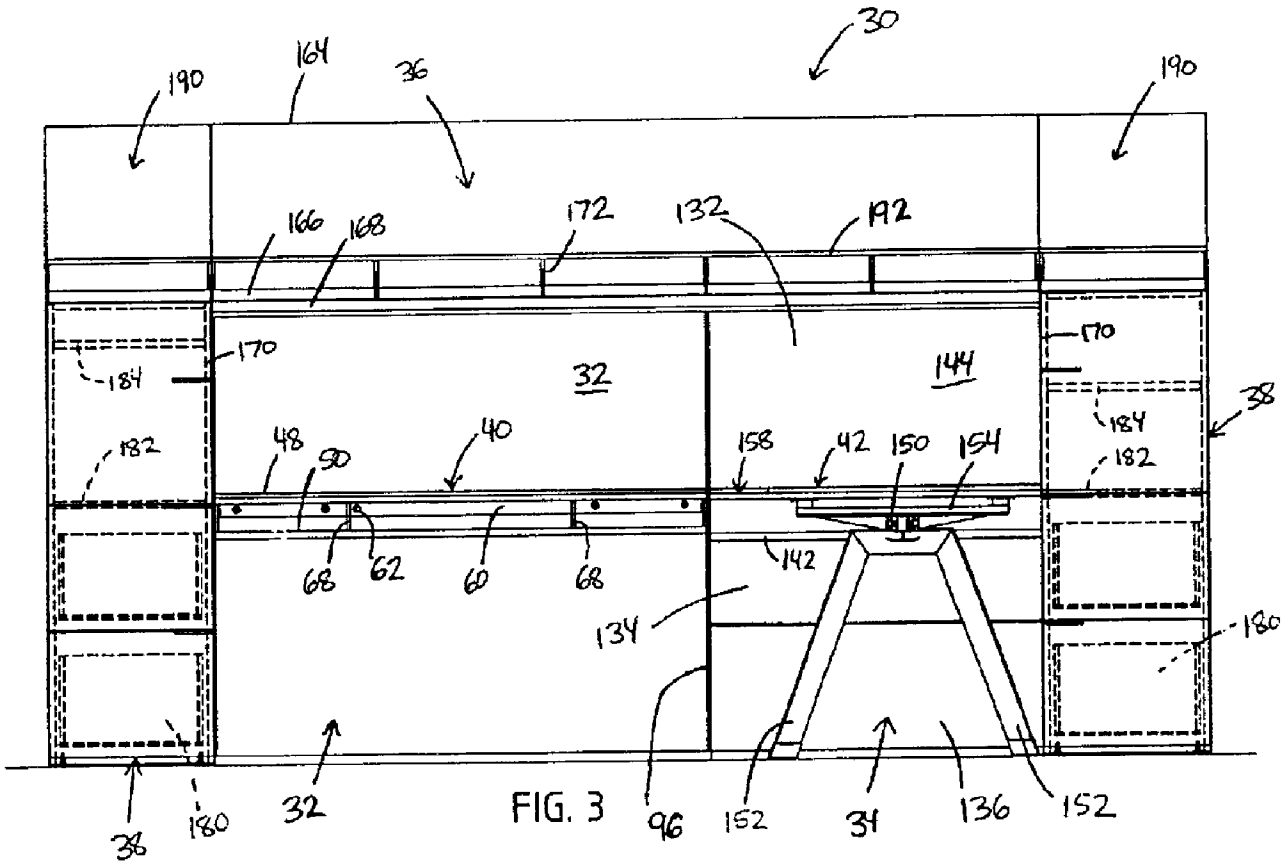
FIG. 3 is front, elevational view of the workstation of FIG. 1.

In addition to the foregoing modifications and substitutions for cabinets 38, it will be understood that a wide variety of other modifications and substitutions are also possible with the present invention. The shapes of, and supporting structure for, work surfaces 42 and 158 could be substantially altered from that illustrated. The size of pivotable wall 32 could be reduced or enlarged. A tackboard could be added to the front of either or both of walls 32 and 34. A horizontal glass panel 192 could be placed on top of fins 172 in top shelf 36 (FIG. 3). The shape and size of technology console 40 and pivotable panel 134 could also be varied, as well as the shape and sizes of a variety of other components. The heights of technology console 40 relative to work surfaces 42 and 158 can also be varied. In the illustrated embodiment, first work surface 42 and upper surface 48 are at substantially the same height. With this height arrangement it is necessary to pivot upwardly upper surface 48 prior to opening pivotable wall 32. Due to gap 162, clearance is provided for the back edge of frame 56 of technology console 56 when pivotable wall 32 is pivoted forward. Such clearance is not an issue if upper surface 48 of technology console 40 is placed at a slightly lower height than first work surface 42.

A handle (not shown) may be included on pivotable wall 32 to facilitate the opening and closing of pivotable wall 32. Preferably the handle is positioned toward the top of pivotable wall 32 along the side opposite pivot axis side 96. Pivotable wall 32 can be held in the closed position by any conventional means, including latches, magnetic plates, locks, etc.

Power outlets, telephony jacks, network ports, and other connections may be included in the interior of frames 98 and 122. Such connections may be supported on any of the cable troughs, side-pieces, or other available structures. Such connections may include wiring that connects these connections to ports on the exterior of workstation 30 at suitable locations, such as anywhere along the rear side of frames 98 and 122 or cabinets 38. When workstation 30 is initially installed, connections can be made from these ports to the permanent connections available in the office or other work environment in which the workstation is installed. Users of workstation 30 will then have easy access to power, telephony, and network connections via the opening of pivotable wall 32, and don't need to hunt behind workstation 30 or elsewhere for making such connections.

While the present invention has been described in terms of the preferred embodiments discussed herein, it will be understood by those skilled in the art that the present invention is not limited to these particular preferred embodiments, but includes any and all such modifications that are within the spirit and scope of the present invention as defined in the appended claims.

What is claimed is:

1. A workstation comprising:

a first vertical wall having a front and a back surface and a first and second side, said first vertical wall having at least one aperture therethrough;

a horizontal work surface attached to and extending forwardly from said front surface of said first vertical wall, said horizontal work surface being configured to support an electronic accessory thereon, the electronic accessory including wiring that is routed through said aperture in said first vertical wall to a location reaward of said back surface of said first vertical wall;

a second vertical wall adjacent to at least a portion of said first side of said first vertical wall; and a hinge mounted to said first vertical wall, said first vertical wall being pivotable about said hinge such that said first vertical wall can pivot between a closed position in which a plane defined by said first vertical wall is generally coplanar with a plane defined by said second vertical wall, and an open position in which the plane defined by said first vertical wall is not coplanar with the plane defined by said second vertical wall, wherein said location rearward of said back surface of said first vertical wall is accessible when said first vertical wall is in said open position.

2. The workstation of claim 1 wherein said first vertical wall is pivotable about a generally vertical pivot axis.

3. The workstation of claim 1 further comprising a horizontal work surface at least partially supported by, and extending forwardly from, said second vertical wall.

4. The workstation of claim 1 wherein said horizontal work surface is upwardly pivotable about a generally, horizontal pivot axis.

5. The workstation of claim 1 further comprising a pivotable panel attached to said second vertical wall.

6. A workstation comprising:

a first vertical wall having a front and back surface and a first and second side;

a horizontal work surface attached to and extending forwardly from said front surface of said first vertical wall;

a second vertical wall adjacent to at least a portion of said first side of said first vertical wall;

a hinge mounted to said first vertical wall, said first vertical wall being pivitobale about said hinge such that said first vertical wall can pivot between a closed position in which a plane defined by said first vertical wall is generally coplanar with a plane defined by said second vertical wall, and an open position in which the plane by said first vertical wall is not coplanar with the plane defines by said second vertical wall; and a shelf positioned on top of said first vertical wall, said shelf including a first portion that extends forwardly from a plane defined by said front surface of said first vertical wall and a second portion that extends rearwardly from a plane defined by said back surface of said first vertical wall.

7. The workstation of claim 6 further comprising at least one aperture defined in said shelf, said aperture defined in said second portion.

8. The workstation of claim 7 wherein said shelf extends over said second vertical wall.

9. The workstation of claim 1 further comprising a second horizontal work surface attached to said first vertical wall.

10. The workstation of claim 9 wherein said second horizontal work surface is positioned underneath, and extends forward from said first vertical wall farther than, said horizontal work surface attached to said first vertical wall.

11. A workstation comprising:

a first vertical wall having a front and a back surface and a first and a second side;

a horizontal work surface attached to and extending forwardly from said front surface of said first vertical wall;

a second vertical wall adjacent to at least a portion of said first side of said first vertical wall; and a hinge mounted to said first vertical wall, said first vertical wall being pivotable about said hinge such that said first vertical wall can pivot between a closed position in which a plane defined by said first vertical wall is generally coplanar with a plane defined by said second vertical wall, and an open position in which the plane defined by said first vertical wall is not coplanar with the plane defined by said second vertical wall; and a horizontal work surface at least partially supported by, and extending forwardly from, said second vertical wall, wherein said horizontal work surfaces on said first and second vertical walls are generally coplanar.

12. The workstation of claim 1 wherein said hinge is mounted to said vertical wall on a side of said first vertical wall adjacent said second vertical wall.

13. The workstation of claim 1 wherein said aperture through said first vertical wall at a location underneath said horizontal work surface attached to said first vertical wall.

14. The workstation of claim 3 further comprising a leg connected to an underside of said horizontal work surface that extends forwardly from said second vertical wall.

15. The workstation of claim 1 further comprising a generally horizontal trough secured to said hack surface of said first vertical wall.

16. The workstation of claim 3 wherein said horizontal work surface of said second vertical wall extends forwardly from said second vertical wail at least twice as far as said horizontal work surface of said first vertical wall extends from said first vertical wall.

17. The work station of claim 1 wherein said horizontal work surface extends substantially the entire length from said first side to said second side of said first vertical wall.

18. A work station comprising:

a first vertical wall having a front and a back surface and a first and a second side;

a horizontal work surface attached to and extending forwardly from said front surface of said first vertical wall;

a second vertical wall adjacent to at least a portion of said first side of said first vertical wall; and a hinge mounted to said first vertical wall, said first vertical wall being pivotable about said hinge such that said first vertical wall can pivot between a closed position in which a plane defined by said first vertical wall is generally coplanar with a plane defined by said second vertical wall, and an open position in which the plane defined by said first vertical wall is not coplanar with the plane defined by said second vertical wall; and a cabinet adjacent said second side of said first vertical wall, said cabinet including an aperture adjacent said second side of said first vertical wall, said aperture defined in said cabinet in a location rearward of a plane defined by said back surface of said first vertical wall.

19. The workstation of claim 2 wherein said horizontal work surface is upwardly pivotable about a generally horizontal pivot axis.

20. The workstation of claim 19 further comprising a horizontal work surface extending forwardly from said second vertical wall.

21. The workstation of claim 20 further comprising a pivotable panel attached to said second vertical wall.

22. The workstation of claim 2 further comprising a roller attach to said first vertical wall, said roller adapted to rollingly support said first vertical wall a floor as said first vertical wall is pivoted between said open and closed positions.

23. A workstation comprising:

a pivotable vertical wail having a front and a back surface, said pivotable vertical wall being pivotable between an open and a closed position;

a horizontal work surface attached to and extending forwardly from said front surface of said pivotable vertical wall;

a substantially horizontal shelf positioned on top of said pivotable vertical wall, said shelf including a first portion that extends forwardly from a plane defined by said front surface of said pivotable vertical wall and a second portion that extends rearwardly from a plane defined by said back surface of said pivotable vertical wall; and at least one aperture defined in said second portion of said shelf.

24. The workstation of claim 23 wherein said pivotable vertical wall is pivotable about a substantially vertical pivot axis.

25. The workstation of claim 24 further comprising a stationary wall positioned alongside said pivotable vertical wall, said stationary wall oriented generally parallel to said pivotable vertical wall when said pivotable vertical wall is in said closed position.

26. The workstation of claim 25 further comprising a horizontal work surface extending forwardly from said stationary wall.

27. The workstation of claim 26 further comprising a pivotable panel attached to said stationary wall underneath said horizontal work surface that extends rearwardly from said stationary wall.

28. The workstation of claim 27 further comprising a leg that supports said horizontal work surface that extends forwardly from said stationary wall.

29. The workstation of claim 24 wherein said horizontal work surface is upwardly pivotable about a generally horizontal pivot axis.

30. The workstation of claim 29 comprising a second horizontal work surface extending forwardly from said pivotable vertical wall.

31. The workstation of claim 29 wherein said horizontal work surface extends substantially all the way across said front surface of said pivotable vertical wall.

32. The workstation of claim 31 further comprising an aperture fined in said pivotable vertical wall below said horizontal work surface, said aperture extending from said front surface to said back surface.

33. The workstation of claim 24 further comprising a roller attached to said pivotable vertical wall, said roller adapted to rollingly support said pivotable vertical wall on a floor as said pivotable vertical wall is pivoted between said open and closed positions.

34. A workstation comprising:

a first vertical wall having a front surface and a back surface, said first vertical wall including a wire receiving aperture therethrough;

a horizontal work surface attached to and extending forwardly from said front surface of said first vertical wall;

a second vertical wall having a front surface and a back surface; and a hinge mounted to said first vertical wall, said first vertical wall being pivotable about said hinge such that said first vertical wall can pivot between a closed position, in which said rear surface of said first vertical wall opposes said front surface of said second vertical wall, and an open position, in which said rear surface of said first vertical wall docs not oppose said front surface of said second vertical wall, said first and second walls defining a wire receiving region between said opposed surfaces when said first vertical wall is in said closed position.

35. The workstation of claim 34, wherein said wire receiving aperture is proximate to said horizontal work surface.

36. The workstation of claim 35, wherein said wire receiving aperture is below said horizontal work surface and said horizontal work surface includes a second wire receiving aperture therethrough.

37. The workstation of claim 34, wherein said first vertical wall is disposed in front of said second vertical wall and conceals at least a portion of said front surface of said second vertical wall when in said closed position.

38. The workstation of claim 34, wherein said first vertical wall includes an upper work surface attached to and extending forwardly from said front surface of said first vertical wall and positioned above said horizontal work surface.

39. The workstation of claim 38, wherein said upper work surface is pivotable about a generally horizontal pivot axis at said front surface of said first vertical wall.

40. The workstation of claim 39, wherein said upper work surface pivotable between a closed position, in which said upper work surface opposes said horizontal work surface to at least partially conceal an upper surface of said horizontal work surface, and an open position, in which said upper work surface is pivoted away from said upper surface of said horizontal work surface.

41. A workstation comprising:

a first vertical wall having a front surface and a back surface, said first vertical wall including a wire receiving aperture therethrough;

a lower horizontal work surface attached to and extending forwardly from said front surface of said first vertical wall; and an upper horizontal work surface pivotally attached to and extending from said front surface of said first vertical wall at a location above said lower horizontal work surface, said upper horizontal work surface being pivotable between a closed position, in which said upper horizontal work surface opposes said lower horizontal work surface to at least partially conceal an upper surface of said lower horizontal work surface, and an open position, in which said upper horizontal work surface is pivoted away from said upper surface of said lower horizontal work surface to at least partially reveal said upper surface.

42. The workstation of claim 41, wherein said wire receiving aperture is proximate to said lower horizontal work surface.

43. The workstation of claim 42, wherein said wire receiving aperture is below said horizontal work surface and said horizontal work surface includes a wire receiving aperture therethrough.

44. The workstation of claim 41 including a second vertical wall having a front surface and a back surface, said first vertical wall being pivotable relative to said second vertical wall between a closed position, in which said rear surface of said first vertical wall opposes said front surface of said second vertical wall, and an open position in which said rear surface of said first vertical wall does not oppose said front surface of said second vertical wall.

45. The workstation of claim 44, wherein said first and second wall, define a wire receiving region between said opposed surfaces when said first vertical wall is in said closed position.

46. The workstation of claim 41 including a second vertical wall adjacent to at least a portion of a side of said first vertical wall, said first vertical wall being pivotable relative to said second vertical wall between a closed position, in which a plane defined by said first vertical wall is generally coplanar with a plane defined by said second vertical wall, and an open position, in which the plane defined by said first vertical wall is not coplanar with the plane defined by said second vertical wall.

* * * * *

UNITED STATES PATENT AND TRADEMARK OFFICE

CERTIFICATE OF CORRECTION

PATENT NO. : 6,854,217 B2
APPLICATION NO. : 10/163958
DATED : February 15, 2005
INVENTOR(S) : Robert J. Bockheim et al.

It is certified that error appears in the above-identified patent and that said Letters Patent is hereby corrected as shown below:

Column 9:
Line 53, Claim 1, “reaward” should be --rearward--.

Column 10:
Line 12, Claim 6, Insert --a-- before “back”.
Line 13, Claim 6, Insert --a-- before “second”.
Line 20, Claim 6, “pivitobale” should be --pivotable--.
Line 25, Claim 6, Insert --defined-- before “by”.
Line 26, Claim 6, “defines” should be --defined--.

Column 11:
Line 2, Claim 13, Insert --is-- before “at”.
Line 8, Claim 15, “hack” should be --back--.
Line 12, Claim 16, “wail” should be --wall--.
Line 48, Claim 22, “attach” should be --attached--.
Line 49, Claim 22, Insert --on-- after “wall”.
Line 53, Claim 23, “wail” should be --wall--.

Column 12:
Line 14, Claim 27, “rearwardly” should be --forwardly--.
Line 29, Claim 32, “fined” should be --defined--.
Line 52, Claim 34, “docs” should be --does--.

Column 13:
Line 9, Claim 40, Insert --is-- after “surface”.

UNITED STATES PATENT AND TRADEMARK OFFICE

CERTIFICATE OF CORRECTION

PATENT NO. : 6,854,217 B2
APPLICATION NO. : 10/163958
DATED : February 15, 2005
INVENTOR(S) : Robert J. Bockheim et al.

It is certified that error appears in the above-identified patent and that said Letters Patent is hereby corrected as shown below:

Column 14:
Line 8, Claim 43, Insert --lower-- before "horizontal".
Line 15, Claim 44, Insert --,-- after "position".
Line 19, Claim 45, "wall" should be --walls--.

Signed and Sealed this

First Day of April, 2008

JON W. DUDAS
*Director of the United States Patent and Trademark Office*